United States Patent [19]

Savage

[11] 4,020,652

[45] May 3, 1977

[54] SELECTOR MECHANISMS

[75] Inventor: Sidney Clifford Savage, Leicester, England

[73] Assignee: Wildt Mellor Bromley Limited, Leicester, England

[22] Filed: Dec. 10, 1975

[21] Appl. No.: 639,584

[30] Foreign Application Priority Data

Dec. 24, 1974 United Kingdom ..... 55698/74

[52] U.S. Cl. ..... 66/50 R; 66/154 A

[51] Int. Cl.[2] ..... D04B 15/78

[58] Field of Search ..... 66/50 R, 154 A, 75 A, 66/25, 42

[56] References Cited

UNITED STATES PATENTS

| | | | |
|---|---|---|---|
| 3,262,285 | 7/1966 | Beguin et al. | 66/50 R |
| 3,365,916 | 1/1968 | Ribler et al. | 66/50 R |
| 3,605,448 | 9/1971 | Ribler | 66/154 A |
| 3,863,465 | 2/1975 | De Cerjat et al. | 66/50 R |
| 3,919,863 | 11/1975 | Sawazaki | 66/50 R |
| 3,948,062 | 4/1976 | Sumitomo | 66/50 R |

*Primary Examiner*—Mervin Stein
*Assistant Examiner*—A. M. Falik
*Attorney, Agent, or Firm*—Irving M. Weiner; Pamela S. Austin

[57] ABSTRACT

A selection mechanism for a knitting machine of the type having individually movable needles provided or associated with selection butts at two or more levels, comprising at least one pair of superimposed permanent magnets, having a common pole piece between them to which opposite pole faces of the magnets are directed, individual pole pieces extending from the other faces of the magnets to form electromagnetic selectors at two different butt levels closely spaced on either side of the common pole piece, and selector coils on the said individual pole pieces adapted to be individually pulsed to divert the magnetic field of the permanent magnet in the pole piece so as to negate its effect on the butts.

8 Claims, 5 Drawing Figures

SELECTOR MECHANISMS

This invention relates to selector mechanisms for knitting machines of the type having individually movable needles.

Although the invention is described hereinafter primarily in relation to circular knitting machines of the rotary cylinder or rotary cambox types, it will be understood that it is also applicable to flat or V-bed machines having individually movable needles.

BACKGROUND OF THE INVENTION

The individually movable needles of a knitting machine are normally housed in tricks and have, on or associated with them, lifting butts engageable with a lifting cam at each selection station whereby the needles may be lifted to knitting position. The needles also have, or are associated with, selection butts engageable with selectors to determine whether the lifting butt engages the lifting cam or is retracted into the trick whereby it misses the lifting cam and the needle does not knit.

With a circular knitting machine having a typical number of needles, such as 1728, and operating at a typical speed, say 30 r.p.m, the needles move past the selectors, or vice-versa in a rotary cambox machine, at a rate approaching 1 per millisecond so that the time available for selection is necessarily very short and decreases as the speed of the machine increases. In order to increase the available time at a given knitting speed, electromagnetically controlled mechanically operated actuators have been stacked in banks of four or six, each operating on only every fourth or sixth selection butt, the selection butts being in echelon or other height-differing formation for this purpose. An alternative has been to have the actuators without moving parts, i.e. selectors operating electromagnetically directly on the selection butts. However, even in this type of selection mechanism timing is very critical since a selection butt held by the selector has to pass out of the field of influence of the selector before the selector can operate to release the next butt following one millisecond behind. It is conventional for the held selection butts to continue to be held on a permanent magnet after selection and if the released selection butts are not released early enough, there is a danger that they may come into the effective field of the permanent magnet and be held rather than released.

SUMMARY OF THE INVENTION

It is an object of the present invention to provide a direct electromagnetic selector mechanism comprising at least two stacked selectors.

According to the present invention, there is provided a selector mechanism for a knitting machine of the type having individually movable needles provided or associated with selection butts at two or more levels, comprising at least one pair of superimposed permanent magnets, having a common pole piece between them to which opposite pole faces of the magnets are directed, individual pole pieces extending from the other faces of the magnets to form electromagnetic selectors at two different butt levels closely spaced on either side of the common pole piece, and selector coils on the said individual pole pieces adapted to be individually pulsed to divert the magnetic field of the permanent magnet in the pole piece so as to negate its effect on the butts.

Preferably, the air gap between the individual pole pieces at their selecting ends is filled with a bar of non-magnetic material.

The selector mechanism may also include a retaining permanent magnet arrangement immediately adjacent and to one side of the selecting ends of the individual pole pieces, and the bar of non-magnetic material may extend between poles or pole pieces of the said arrangement.

The selector mechanism may also include a cam for engaging elements associated with the needles for bringing the selector butts into engagement with the selector mechanism to be held or released thereby according to the selection required.

In one particular form of the invention, a knitting machine has needles each associated with a jack having a springy extension carrying a lifting butt which is normally urged by the springiness of the extension out of the needle trick to engage a lifting cam at each selection station. A rocking presser is arranged to depress the jack extension with its lifting butt into the trick. The rocking presser has the selector butt on it at one of two levels and the pressers are cammed in turn against the action of the springy extension of the jack to bring the selection butts against the selectors. If the coil is energized to divert the permanent magnetic field, the spring action of the jack extension moves the butt away and the lifting butt is released to engage the lifting cam. If the coil is not energized, then the permanent magnet holds the butt against the action of the spring extension and the butt is transferred to the holding magnet which retains the butt until the lifting butt has passed behind the lifting cam.

The invention will be further described with reference to the accompanying drawings, in which:

FIG. 1 is a sectional view of part of a needle cylinder of a circular knitting machine illustrating a preferred form of the invention;

FIG. 1*a* is a view similar to the part of FIG. 1 in the circle A, but showing an opposite butt formation;

DETAILED DESCRIPTION OF SOME PREFERRED EMBODIMENTS OF THE INVENTION

Figure 1:
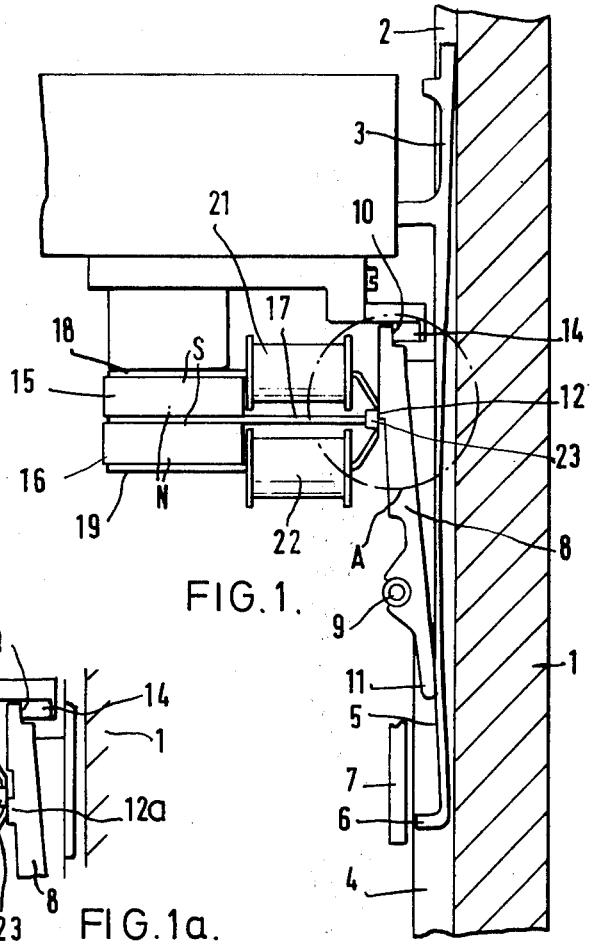
Figure 4:
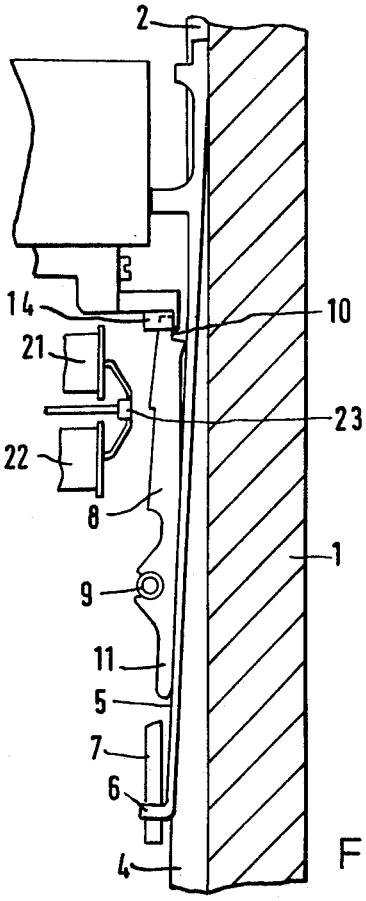
FIG. 4 is a view generally similar to FIG. 1 showing the parts in a knit position.

FIGS. 1 and 4 each show a needle cylinder 1 having needles (not shown) in tricks 2. Each needle is associated with a jack 3 in its trick 2 and extending into a deeper extension 4 of the trick 2. The lower part 5 of the jack is springy and is inherently urged to the position shown in FIG. 4 in which a lifting butt 6 is extended out of trick extension 4 into a path including a lifting cam 7 whereby the jack and its associated needle are lifted into knitting position. This arrangement is the same whether the needle cylinder 1 rotates or the cambox, including cam 7, rotates.

A rocking presser 8 is associated with each jack 3, being mounted on a fixed pivot 9 associated with the trick extension 4. At its upper end the presser 8 has a rebate 10 and its lower end 11 is adapted to bear on the jack 3 to hold it in trick extension 4 when the upper end of the presser is held out. Alternate pressers 8 have a butt formation 12 in the position shown in FIG. 1, while the intervening presser 8 has a butt formation 12*a* in the position shown in FIG. 1*a*.

Figure 3:
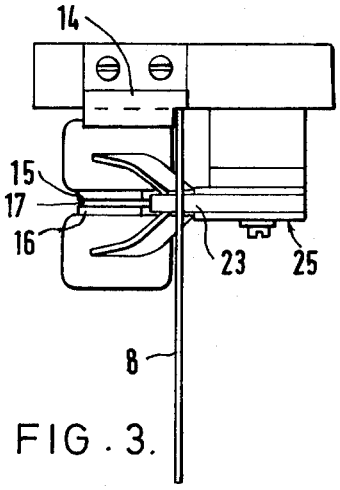
FIG. 3 is a development of part of the structure of FIG 1.
Figure 1A:
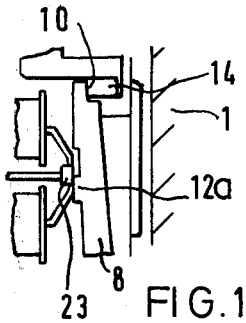
Figure 2:
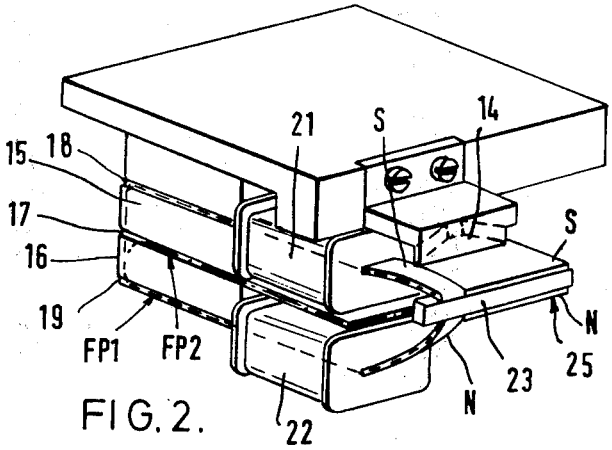
FIG. 2 is a perspective view of a selector mechanism shown in FIG. 1.

To control the movement of the presser 8, there is provided a selector mechanism illustrated more particularly in FIGS. 2 and 3. A cam 14 engages the rebates 10 on the pressers to move them successively to the position of FIG. 1. The selector mechanism further comprises a pair of superimposed permanent magnets 15 and 16 with a common soft iron pole piece 17 between opposed pole faces of opposite polarity. Individual pole pieces 18 and 19 are arranged on the other pole faces of the magnets 15 and 16, and pass through coils 21 and 22 and are then bent towards each other and downstream of the passage of butts. Between the free ends of the pole piece 18 and 19 and adjacent the free end of the pole piece 17 there is located a bar 23 of non-magnetic material. As illustrated in FIG. 1 and 1*a* the bent ends of the pole pieces 18 and 19 form selectors at closely spaced positions on either side of the pole piece 17 for butts 12 and 12*a* at their respective levels. The selection is provided by energization or non-energization of the coils 21 and 22 to demagnetize or not the pole pieces and divert or not the fields of the permanent magnets 15 and 16 from the respective pole pieces. If the field is diverted, the springiness of the jack extension 5 will cause the jack to revert to the FIG. 4 position, while if it is not, the butt remains held by the selector and will pass on to a holding permanent magnet arrangement 25 consisting of an extension of the bar 23 and a pair of pole pieces. This ensures that the arrangement stays in the FIG. 1 position until the lifting butt 6 is behind the lifting cam 7. The bar 23 may stand proud of the magnetic pole pieces to keep the butts 12 and 12*a* from actual engagement with the magnet pole pieces.

Should the coil 21 surrounding the upper pole piece be pulsed then this pole piece will be demagnetized, thus diverting or deforming one "leg" of the flux path FP1. However, by virtue of the intermediate pole piece 17, a flux path "leg" FP2 is automatically set up which ensures that there is no loss of attraction sustained in the lower pole piece by the demagnetisation of the upper pole piece.

When the coil surrounding the lower pole piece is pulsed, a reversal of the above recited events takes place and the intermediate pole piece then provides a path for the flux associated with the upper pole piece.

Although, in the drawings, the upper pole piece and upper retaining magnet have a south polarity and the lower piece and magnet have a north polarity, obviously the polarities may be reversed. It is in fact preferable to arrange the selecting units at successive knitting stations in an alternating sequence so that the upper and lower series of butts are attached respectively by a north pole magnet at alternate selecting stations and a south pole magnet at intervening stations.

Should it be required to have more than two different levels of butt, then further pairs of permanent magnets 15 and 16 and associated parts may be included in the selector mechanism. A single such magnet may also be used in addition if an odd number of levels of butts is used.

Various other modifications may be made within the scope of the invention. I claim:

1. In a selection mechanism for a knitting machine of the type having individually movable needles associated with selection butts at at least two levels: the improvement that the selection mechanism comprises at least one pair of superimposed permanent magnets, a common pole piece between the said pair of magnets with opposite pole faces of magnets directed towards said common pole piece, a pair of individual pole pieces extending from the other pole faces of the said pair of magnets to form selectors at two different butt levels closely spaced on either side of the common pole piece, and individual selector coils on the said individual pole pieces and adapted to be individually pulsed to divert the magnetic field of the permanent magnet in the pole piece so as to negate its effect on the butts and effect a selection.

2. A selection mechanism as claimed in claim 1, in which there is an air gap between the individual pole pieces at the selecting ends; and comprising a bar of non-magnetic material in the said air gap.

3. A selection mechanism as claimed in claim 1, further including a retaining permanent magnet arrangement immediately adjacent and to one side of the selecting ends of the individual pole pieces.

4. A selection mechanism as claimed in claim 2, further including a retaining permanent magnet arrangement immediately adjacent and to one side of the selecting ends of the individual pole pieces.

5. A selection mechanism as claimed in claim 4, wherein the said bar of non-magnetic material extends between poles or pole pieces of the said retaining permanent magnet arrangement.

6. A selection mechanism as claimed in claim 1, further including a cam for engaging elements associated with the needles for bringing the selection butts into engagement with the selector mechanism to be held or released thereby according to the selection required.

7. A multi-feed knitting machine of the type having individually movable needles arranged in tricks and associated with selection butts at at least two levels, and a plurality of selection stations at which the needles are selected to knit or not to knit at respective feeds: the improvement that each selection station includes a selection mechanism comprising at least one pair of superimposed permanent magnets, having a common pole piece between them to which opposite pole faces of the magnets are directed, individual pole pieces extending from the other faces of the magnets to form electromagnetic selectors at two different butt levels closely spaced on either side of the common pole piece, and selector coils on the said individual pole pieces adapted to be individually pulsed to divert the magnetic field of the permanent magnet in the pole piece so as to negate its effect on the butts.

8. A knitting machine as claimed in claim 7, comprising a jack associated with each needle and slidable in its trick, each jack having a springy extension a lifting butt on each springy extension arranged so as normally to extend out of the trick, a rocking presser associated with each jack and adapted to be rocked to depress the jack extension and lifting butt into the trick, the selection butts being on the rocking pressers, a lifting cam associated with each selection station to engage such lifting butts as remain projecting out of the trick to lift them and move the associated needles to knitting position, and cam means for rocking the pressers in turn against the action of the springy extensions to bring the selection butts against the selectors and to retract the lifting butts into the tricks.

* * * * *